US009908733B2

(12) United States Patent
Roska et al.

(10) Patent No.: US 9,908,733 B2
(45) Date of Patent: Mar. 6, 2018

(54) STATIC REDUCTION ROLLER AND METHOD FOR REDUCING STATIC ON A WEB

(71) Applicant: 3M INNOVATIVE PROPERTIES COMPANY, St. Paul, MN (US)

(72) Inventors: Fred J. Roska, Woodbury, MN (US); Chris J. Tanley, Woodbury, MN (US); Kevin B. Newhouse, Houlton, WI (US); Bruce E. Tait, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/653,322

(22) PCT Filed: Dec. 17, 2013

(86) PCT No.: PCT/US2013/075721

§ 371 (c)(1),
(2) Date: Jun. 18, 2015

(87) PCT Pub. No.: WO2014/099951

PCT Pub. Date: Jun. 26, 2014

(65) Prior Publication Data

US 2016/0185549 A1 Jun. 30, 2016

Related U.S. Application Data

(60) Provisional application No. 61/739,939, filed on Dec. 20, 2012.

(51) Int. Cl.
*B65H 27/00* (2006.01)
*B65H 20/02* (2006.01)

(52) U.S. Cl.
CPC ..... *B65H 27/00* (2013.01); *B65H 20/02* (2013.01); *B65H 2404/5511* (2013.01); *B65H 2515/716* (2013.01)

(58) Field of Classification Search
CPC .. B65H 20/02; B65H 27/00; B65H 2404/533; B65H 2404/5331; B65H 2515/70; B65H 2515/716

(Continued)

(56) References Cited

U.S. PATENT DOCUMENTS 3,634,726 A 1/1972 Pierre
3,671,806 A * 6/1972 Whitmore ..... B65H 29/125 361/212

(Continued)

FOREIGN PATENT DOCUMENTS

CN 202379510 8/2012
DE 2363284 6/1975

(Continued)

OTHER PUBLICATIONS

Hull, "A Method for Studying the Distribution and Sign of Static Charges on Solid Materials", Journal of Applied Physics, Dec. 1949, vol. 20, pp. 1157-1159.

(Continued)

*Primary Examiner* — Michael C McCullough
(74) *Attorney, Agent, or Firm* — Robert H. Jordan

(57) ABSTRACT

The present disclosure describes a looped pile static reduction roller (100, 200, 300), an apparatus (400) including the looped pile static reduction roller, and a technique to neutralize static and static patterns from a polymeric film surface during processing, to enable higher speeds and fewer defects during web transport. The looped pile static reduction roller includes a static reduction engagement cover (160, 260, 360) that is resilient and can facilitate discharge (Continued)

of static from the web to ground before, during, and after contact with a charged web (320, 420).

27 Claims, 4 Drawing Sheets

(58) Field of Classification Search
USPC ..... 226/94; 492/43, 29; 271/208
See application file for complete search history.

(56) References Cited

U.S. PATENT DOCUMENTS

| | | | | |
|---|---|---|---|---|
| 3,737,963 | A | 6/1973 | Postulka | |
| 4,163,307 | A | 8/1979 | Papendick | |
| 4,385,824 | A | 5/1983 | Hollo | |
| 5,605,607 | A * | 2/1997 | LaRose | B65H 23/00 204/164 |
| 5,690,014 | A | 11/1997 | Larkin | |
| 5,719,739 | A | 2/1998 | Horiguchi | |
| 6,120,864 | A | 9/2000 | Chiricosta | |
| 6,963,112 | B2 | 11/2005 | Chen | |
| 2015/0093570 | A1 | 4/2015 | Tse et al. | |

FOREIGN PATENT DOCUMENTS

| | | | | |
|---|---|---|---|---|
| JP | 2004-307160 | | 11/2004 | |
| JP | 2006-256720 | | 9/2006 | |
| WO | WO 2011-038279 | | 3/2011 | |
| WO | WO 2011-038284 | | 3/2011 | |
| WO | WO 2011038284 | A1 * | 3/2011 | B65H 27/00 |
| WO | WO 2014-035850 | | 3/2014 | |
| WO | WO 2014-055380 | | 4/2014 | |

OTHER PUBLICATIONS

International Search Report for PCT International Application No. PCT/US2013/075721 dated Mar. 27, 2014, 4 pages.

"Fixing Common Static Problems", XP055285366, AlphaLab, Salt Lake City, Utah, USA [on line], [retrieved from the Internet on Jul. 1, 2016] <http://web.archive.org/web/20111017104004/http://www.trifield.com/content/fixing-common-static-problems/>, pp. 5.

* cited by examiner

STATIC REDUCTION ROLLER AND METHOD FOR REDUCING STATIC ON A WEB

CROSS REFERENCE TO RELATED APPLICATIONS

This application is a national stage filing under 35 U.S.C. 371 of PCT/US2013/075721, filed Dec. 17, 2013, which claims priority to U.S. Provisional Application No. 61/739,939, filed Dec. 20, 2012, the disclosure of which is incorporated by reference in its/their entirety herein.

BACKGROUND

Many products are often manufactured in a continuous web format for the processing efficiencies and capabilities that can be achieved with that approach. The term "web" is used here to describe thin materials which are manufactured or processed in continuous, flexible strip form. Illustrative examples include thin plastics, paper, textiles, metals, and composites of such materials.

Such operations typically entail use of one or more, frequently many more, rollers (sometimes referred to as rolls) around which the web is conveyed throughout the process through a series of treatments, manufacturing steps, etc. Rollers are used for many purposes, including, for example, turning the direction of the web, applying pressure to the web in nip stations, positioning the web for travel through coating and other treatment stations, positioning multiple webs for lamination, stretching webs, etc. Rollers used in such operations are made of a variety of materials, with the selection dependent in large part upon the web(s) being handled, the operational parameters (for example, speed, temperature, humidity, tension, etc.). Some illustrative examples of materials used to make rollers or covering surfaces thereon include rubber, plastics, metal (for example, aluminum, steel, tungsten, etc.), foam, felt, knitted fabrics, and woven fabrics. Specific rollers may be configured to be free rolling, powered (in the same direction the web is traveling or opposite direction, at the same or different speed than the web is traveling, etc.), etc. depending upon the desired tension parameters.

Static electricity can be generated on the surfaces of the polymeric film upon contacting any roller during film processing. An apparatus and technique are needed to reliably reduce static electricity generated on polymeric film.

SUMMARY

The present disclosure describes a looped pile static reduction roller, an apparatus including the looped pile static reduction roller, and a technique to neutralize static and static patterns from a polymeric film surface during processing, to enable higher speeds and fewer defects during web transport. The looped pile static reduction roller includes a static reduction engagement cover that is resilient and can facilitate discharge of static from the web to ground before, during, and after contact with a charged web. In one aspect, the present disclosure provides a static reduction roller that includes a roller having a low-conductivity major surface, a central axis, and two ends; and a static reduction engagement cover having an inner surface and an outer surface, the inner surface adjacent the major surface of the roller. The static reduction engagement cover has a resilient surface which engages with the web (i.e., sometimes referred to herein as an "engagement surface"); and electrically conductive fibers, wherein the electrically conductive fibers are disposed throughout the resilient engagement cover such that a portion of the electrically conductive fibers are proximate the outer surface.

In another aspect, the present disclosure provides an apparatus for reducing static on a web that includes a static reduction roller. The static reduction roller includes a roller having a low-conductivity major surface, a central axis, and two ends; and a static reduction engagement cover having an inner surface and an outer surface, the inner surface adjacent the major surface of the roller. The static reduction engagement cover includes a resilient engagement surface; and electrically conductive fibers, wherein the electrically conductive fibers are disposed throughout the resilient engagement surface such that a portion of the electrically conductive fibers are proximate the outer surface. The static reduction roller is capable of rotating around the central axis. The apparatus further includes an electrically conductive roll in engaging contact with the outer surface of the static reduction engagement cover and in electrical contact with an electrical ground, wherein a first major surface of a web material contacts the static reduction roll essentially parallel to the central axis in a first region, and the electrically conductive roll contacts the static reduction roll in a second region separated from the first region while conveying the web material in a downweb direction perpendicular to the central axis. In yet another aspect, the present disclosure provides a method for reducing static on a web that includes providing the apparatus for removing static on a web; conveying the web material in a downweb direction perpendicular to the central axis; and contacting the moving web material with the resilient engagement surface of the static reduction roll, thereby removing static charge from the web material and discharging the static charge to the electrical ground. In yet another aspect, the present disclosure provides the method for reducing static on a web further including charging the web material with a corona discharge prior to contacting the moving web material with the resilient engagement surface.

In yet another aspect, the present disclosure provides an apparatus for reducing static on a web that includes a first and a second static reduction roller. The first and the second static reduction roller each includes a roller having a low-conductivity major surface, a central axis, and two ends; and a static reduction engagement cover having an inner surface and an outer surface, the inner surface adjacent the major surface of the roller. The static reduction engagement cover includes a resilient engagement surface; and electrically conductive fibers, wherein the electrically conductive fibers are disposed throughout the resilient engagement surface such that a portion of the electrically conductive fibers are proximate the outer surface. The first and second static reduction roller are each capable of rotating around the central axis. The apparatus further includes a first and a second electrically conductive roll in engaging contact with the outer surface of each of the static reduction engagement covers and in electrical contact with an electrical ground, wherein a first major surface of a web material contacts the first static reduction roll essentially parallel to the central axis in a first region, and the electrically conductive roll contacts the static reduction roll in a second region separated from the first region while conveying the web material in a downweb direction perpendicular to the central axis. Further, a second major surface of the web material contacts the second static reduction roll essentially parallel to the central axis in a third region, and the second electrically conductive roll contacts the second static reduction roll in a fourth region separated from the third region while conveying the web material in the downweb direction perpendicular to the central axis. In yet another aspect, the present disclosure provides a method for reducing static on a web that includes providing the apparatus for removing static on a web; conveying the web material in a downweb direction perpendicular to the central axis; and contacting the moving web material with the resilient engagement surface of the static reduction roll, thereby removing static charge from the web material and discharging the static charge to the electrical ground. In yet another aspect, the present disclosure provides the method for reducing static on a web further including charging the web material with a corona discharge prior to contacting the moving web material with the resilient engagement surface.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings, where like reference numerals designate like elements, and wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1:
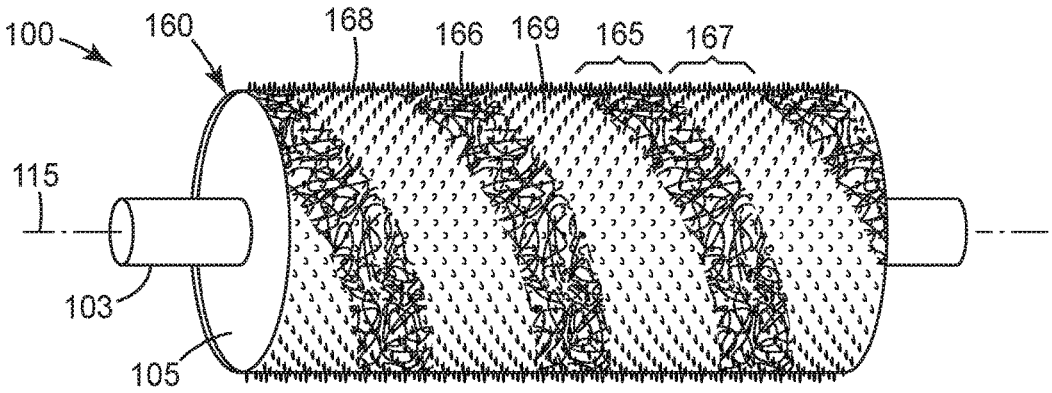
FIG. 1 shows a perspective schematic view of a static reduction roller.

Static electricity is known to be generated during polymeric film making, film transport, and film coating and treating processes including corona treatment. Static patterns are an electrostatic change on the film surfaces which can persist even after treatment with readily available static neutralization devices. As a result of these static patterns, defects in the polymeric film can occur, including increased affinity for debris, coating defects particularly in non-polar solvent formulations, and liquid coating flow distortions. In one aspect, the present disclosure describes a looped pile static reduction roller, an apparatus including the looped pile static reduction roller, and a technique to neutralize static patterns from a polymeric film surface during processing, to enable higher speeds and fewer defects during web transport. The looped pile static reduction roller includes a static reduction engagement cover that is resilient and can facilitate discharge of static from the web to ground before, during, and after contact with a charged web.

The disclosed static reduction rollers can eliminate surface static of plastic or polymeric films and has the potential to be installed on nearly every film processing line. The disclosed static reduction rollers can also be installed in areas where currently available static reduction systems cannot be readily fitted, such as in applications on winders and unwinders that rotate. Further, the disclosed static reduction roller does not require maintenance and can be replaced at low cost in caparison to currently available static reduction systems. The apparatus can be placed or installed in close proximity of solvent based coating equipment to control the explosion hazards due to surface static.

The following terms are used herein as having the indicated meaning; other terms are defined elsewhere in the specification.

"Convey" is used to mean moving a web from a first position to a second position wherein the web passes through engaging contact with a roller.

"Engaging contact" is used to refer to contact between the web and the roller such that as the web is conveyed it engages with the static reduction engagement cover of the roller compressing the cover in response to contact with the web.

"Engagement surface" is the radially outwardly facing portion of the static reduction engagement cover that is directly contacted with the web when the web is conveyed.

"Engagement zone" is the portion of the engagement surface that is in direct contact with the web at a particular moment.

"Resilient" is used to refer to the capability of being deformed or compressed and then recovering to earlier shape or loft.

"Web" refers to a flexible, elongated ribbon or a continuous, in one direction, sheet of material.

In the following description, reference is made to the accompanying drawings that forms a part hereof and in which are shown by way of illustration. It is to be understood that other embodiments are contemplated and may be made without departing from the scope or spirit of the present disclosure. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

As used herein, when an element, component or layer for example is described as forming a "coincident interface" with, or being "on" "connected to," "coupled with" or "in contact with" another element, component or layer, it can be directly on, directly connected to, directly coupled with, in direct contact with, or intervening elements, components or layers may be on, connected, coupled or in contact with the particular element, component or layer, for example. When an element, component or layer for example is referred to as being "directly on," "directly connected to," "directly coupled with," or "directly in contact with" another element, there are no intervening elements, components or layers for example.

Film rollers having coverings that use looped pile exteriors providing a resilient engagement surface have been described for use with transport rollers in a webline, for example, in PCT Patent Publication Nos. WO 2011/038279, entitled WEB CONVEYANCE METHOD AND APPARATUS USING SAME; WO 2011/038284, entitled METHOD FOR MAKING ENGAGEMENT COVER FOR ROLLERS FOR WEB CONVEYANCE APPARATUS; and also in co-pending U.S. Patent Application Publication Nos. 2015/0217960, entitled ADAPTABLE WEB SPREADING DEVICE and 2015/0274483, entitled LOOPED PILE FILM ROLL CORE.

Static electricity can be generated during polymeric film making, film transport, and film coating and treating processes including corona treatment. The positive and/or negative charges that can be generated either attract or repel each other, as known in the art. A charged film of either polarity can be attracted to uncharged insulators or conductor surfaces. These attractions become especially evident in converting operations such as sheeting, bag making and die-cutting, where the film is no longer constrained by the mechanical structure of the web and its transport system. Polymeric film webs can develop high charge levels in the range of 10 kV to 40 kV or more.

The strong electrostatic fields associated with these high charges can cause surface contamination of the webs by attracting dust particles, fibers, bugs, hair, processing debris, and the like. Surface contamination can cause quality problems with printing, coating, and laminating, and cleanliness problems with food, medical and pharmaceutical packaging films. Control of high levels of static is very important in many industries, and the equipment and techniques to control static are referred to as static neutralizers and static control technology.

Some of the problems due to static include: uneven coatings and "wicking" of inks; electrostatic discharge (ESD) of a charged conductor or a highly charged insulator, which can result in ignition of hazardous vapors in coating heads and gravure printing operations; ESD disruption of logic in programmable logic controllers (PLC) and sensing equipment which can cause processing errors and costly down time; and high static charges, especially on a wind-up roll, can result in uncomfortable electrical shocks to the operator when approaching the roll or touching the machine frame.

High levels of static can also result in air-breakdown discharges, which can supply counter ions that result in bipolar static patterns. These bipolar static patterns can be described as an electrostatic charge on one or both of the film surfaces, which can persist even after treatment with readily available static neutralization devices. Defects in the polymeric film can occur as a result of these bipolar static patterns. These defects can include, for example, an increased affinity for debris; coating defects, particularly in non-polar solvent formulations; and liquid coating flow distortions. Because of their bipolar nature, these bipolar static patterns can effectively screen themselves from conventional static neutralizing technology, which relies on the establishment of an electric field between the neutralizer and the substrate to attract ions having the appropriate polarity.

Many films or substrates are non-conductive, so they cannot be neutralized by intimate contact with conductive grounding. In these cases, counter-ions must be produced to counter or neutralize the static charges. A fundamental of static control technology with non-conductive films or substrates is that all neutralizers must produce ions, which can then be attracted by the charge on a film or substrate. If the initial charge on the film is positive, negative ions will be attracted; when these negative ions reach the film, they neutralize at least a portion of the positive charge on the film. A similar effect occurs if the film or substrate is negatively charged, with positive ions being attracted and thereby neutralizing at least a portion of the negative charge on the film.

The technique of ion production is different for the various types of neutralizers. Radioactive neutralizers produce ions of both polarities by ionizing the surrounding air with either alpha or beta radiation. Radioactive neutralizers can be limited in their efficiency, and the use of radioactive materials may be undesired in many locations.

Other types of neutralizers use corona discharge to produce these ions. A corona discharge is a partial electric breakdown in a gaseous medium, which occurs between two electrodes. The electrode pairs are often asymmetrically shaped, for example pairing a point and plane. In this type of geometry, a non-uniform electric field in the inter-electrode gap will result from a voltage potential difference. The electric field will be more intense at the sharp electrode, typically referred to as the high field electrode. If the voltage potential difference is high enough, the breakdown field strength of the air can be exceeded near the high field electrode, which can then result in air ionization and the formation of ion pairs. This type of neutralizer can be classified into two distinct types: 1) active (that is, powered) neutralizers and 2) passive (that is, unpowered) neutralizers.

In active neutralizers, a voltage potential difference is applied between a pointed electrode and the housing of the neutralizer. A charged film in front of the neutralizer distorts the electric field such that a portion of the ions having an opposite polarity are attracted by the film. Active neutralizers also produce ions when the charge density on the film is low. There is no threshold value (that is, onset of current flow) for an active neutralizer, because the electric field strength at the high field electrode is mainly determined by the potential difference between the high field electrode and the housing (a value set by the power supply). There are DC and AC neutralizers (with respectively a DC and an AC potential difference between corona electrode and housing). Active neutralizers can have advantages of efficiency, where large numbers of ions pairs can be produced, but can also have many limitations, including: over-compensating, high voltage power connection dangers, and expense.

In contrast, passive neutralizers rely on asymmetric geometry and the resultant electric field generated from the close proximity of a charged film or substrate to the high field electrode of the passive neutralizer to produce ion pairs A common passive neutralizer system often consists of either needles or metallic brushes, electrically connected to earth ground, suspended above the surface to be neutralized. The highly charged surface sets up a potential gradient between the needle or bustle points and the charged body. When a threshold level of voltage is achieved, the electric field will be sufficient to ionize air in the immediate vicinity of the needle or bustle points. The threshold level of voltage determines the level of voltage reduction that can be achieved. This system is known as the induction method of ionization, because of the induced charge in the passive static eliminator. In order to maximize the amount of induced charges, the passive neutralizer system must adequately grounded.

One common application is to connect the passive neutralizer to earth ground. If a grounded passive neutralizer is positioned over a charged film or substrate, and if the charge density on the film is high enough, a corona discharge can occur, creating ion pairs at the high field electrode of the passive neutralizer. The ions of the opposite polarity are attracted by the film or substrate, and subsequently neutralize its charge. No ions are produced if the charge density on the film or substrate is low, because then the breakdown field strength of the air is not reached at the surface of the passive neutralizers high field electrode. The onset of current flow to the charged film or substrate is termed the corona or voltage threshold of the neutralizer. One advantage of this system is its simplicity, needing no power supply. One disadvantage is the passive neutralizer no longer creates ion pairs below the threshold level of the corona, which can result in an inability to reduce the static charge to negligible levels under normal operating conditions. A passive neutralizer which can continue to create ion pairs under low voltage conditions, that is has a low corona threshold, is very advantageous. The static reduction engagement cover described herein, can function with a low voltage threshold in several operating modes. Consequently the passive neutralizer of the present invention can reduce static levels to very low levels, similar to the low static levels achieved with active neutralizers but without the many limitations of active neutralizers.

Several factors can affect the corona threshold of passive neutralizers. In one particular embodiment, the sharpness of the high field electrode can contribute significantly to the corona threshold; the sharpness of the high field electrode can be due to, for example, the fiber diameter, a fiber end, a fiber kink, or a fiber bend.

In one particular embodiment, the proximity of other charge sources and grounds to the high field or ionizing electrode can also contribute significantly to the corona threshold. When the charged film web passes over an idler roll or comes into contact or close proximity to another surface, its field becomes partially or totally collapsed. Even though the web is still charged, its field cannot be detected and measured. This condition is known as field suppression or attenuation. The degree of suppression is dependent upon the distance relationship to the background surface, physical and electrical characteristics of the background surface, and the thickness of the charged material. Attempting field measurements in these conditions often results in errors when evaluating or auditing a process for static problems. In addition, in areas where field suppression is evident, passive static neutralizers cannot be effectively applied since the voltage of the film is lowered without neutralization, which is desired, but rather through attenuation. In some cases, the fiber diameter, the spacing and concentration of conductive fibers within the nonconductive fiber matrix, the spacing of the conductive fibers to the charged film or substrate during operation, and minimizing the attenuation effect of nearby conductive elements, can all be parameters which may be adjusted to affect the corona threshold. In one particular embodiment, the voltage attenuation can be reduced by engaging the roller cover of the present invention with a non-conductive roll.

The present disclosure may be used with a wide variety of web materials, illustrative examples including plastics, paper, metal, and composite films or foils. Web material will typically be provided in roll form, for example, wound upon itself or on a core, but may be provided in other configuration if desired.

In some embodiments, the web material is provided from an intermediate storage state, for example, from an inventory of raw materials and/or intermediate materials. In other embodiments, the web material may be provided to the process of the present disclosure directly from precursor processing, for example, such as the take off feed from a film forming process. The web material may be single layer or multilayer, in some instances the described invention is used to convey the web material through manufacturing operations in one or more additional layers and/or one or more treatments are applied to a web material.

Configuring the web material into passing configuration simply refers to arranging the web material into position and orientation such that it can be put into engaging contact with the engagement surface of a roller in accordance with the disclosure. In many embodiments, this will simply comprise unrolling a portion of the web material which is in roll form such that it can be put into engaging contact with the engagement surface. In other illustrative embodiments, the web material is formed in a precursor portion of the operation, that is, in line, and passed directly into a web conveying apparatus without having been wound into roll form, for example, the polymeric material is extruded or cast in line to form a film which, at that point is in passing configuration without ever having been wound into roll form, is the web material conveyed by the apparatus of the disclosure.

In some cases, static patterns reflect an electrostatic charge, readily characterized by dusting, which can persist after treatment with static neutralization devices are formed during film making, film transport, and film coating processes, or during the process of corona treatment. When a polyethylene terephthalate (PET) film, or other polymeric film, is dusted with certain charged powders prior to neutralization with a static bar, many types of patterns can be observed, as described elsewhere. These patterns can be classified into two general types: unipolar and bipolar. The unipolar patterns are often tree shaped or large patchy areas. The bipolar patterns are typically concentric circles or arcs. If the PET film is neutralized with a static bar and then dusted, only the bipolar patterns remain. This is a direct result of the principle in which static eliminator bars operate. An electric field must be established between the film and the bar to attract ions of the appropriate polarity to the film. A bipolar pattern effectively screens itself from the static bar, hence the appearance of permanence. In addition, the bipolar nature of static patterns results in charge stability. High levels of charge density are possible due to the stabilizing presence of counter ions.

A functional test for bipolar static patterns includes a dispersion of $TiO_2$ and SBR (Kraton) in toluene spread onto a PET film with a coating bar. Disruption of the coating occurs in identical locations of static patterns, as characterized by dusting, as described elsewhere. The bipolar static patterns should be removed from a film surface to avoid coating disruptions. In addition to higher quality coating higher process speeds are possible with minimal coating disruptions such as those due to static patterns.

Static patterns can be characterized by dusting. When fine powder (talc, NaHC03, etc.) is dusted onto the web, the powder will adhere strongly in certain regions yielding a pattern. More detailed information can be obtained by the use of charged powders. When fine powders of Lycopodium and Sulfur are mixed, their different charge affinities allow for a charge transfer to take place. The Lycopodium powder (dyed blue) becomes positively charged while the sulfur (dyed red) becomes negatively charged. When a PET film is dusted with such a bipolar mixture, the polarity of charged regions is readily discernible (H. H. Hull, J. Appl. Phys., 20, 1157-1159, December 1949).

In one particular embodiment, a technique to neutralize static and static patterns is provided where a film is first charged via a DC corona process followed by contact with a static reduction roller. The DC corona process first alters the polarity of the static pattern, on a first major surface, to a unipolar state followed by contact with a static reduction roller, and then an opposing major surface is similarly treated. In one particular embodiment, the DC corona charges the film while the film is contact with a grounded backup roll to offer a consistent ground reference. The backup roll may have a dielectric coating or dielectric layer for improved wetting and to prevent air breakdown as the film leaves this roll.

The addition of multi-conductive filaments having a size range between about 3 to about 100 microns into circular knitted terry loops made of Polyester, Nylon, Polyproylene, and Ethylene materials can reduce or even eliminate surface static on polymeric films. These static reduction engagement covers will cover a non-conductive roller which transports the polymeric film, and corona effect neutralizing ions can be created at the entry and exit wrap angles of a non-conductive film transport roll. In one particular embodiment, a very fine spacing of active conductive fibers can be used to generate a corona with a low corona threshold.

Such static reduction rolls having static reduction engagement covers can offer not only the benefits for web transport, but may also eliminate the need for additional static reduction equipment. The static reduction engagement covers can be fitted on rolls that cannot be fitted with static reduction bar such as found in a turret unwind/winder.

Each of the static reduction rolls described herein can be used in a web conveying apparatus to reduce or eliminate sagging and bagging of a thin web during processing. Depending upon the embodiment, a web conveying apparatus may comprise one or more static reduction rollers with engagement covers, and may further comprise one or more rollers not equipped with such engagement covers. Some embodiments will employ dozens or more rollers in sequence, with some, most, or even all of the rollers being equipped as static reduction rollers with engagement covers. In embodiments of apparatuses comprising two or more static reduction rollers equipped with static reduction engagement covers, the static reduction engagement covers may be selected to have different properties to optimize performance at different locations within the manufacturing sequence.

An advantage of the present invention is that typically engagement covers may be readily installed on existing rollers without significant equipment change or significant reconfiguration of apparatus components. Thus, existing web conveying apparatuses may be readily refit with engagement covers of the invention to achieve attendant improvements in performance.

The manner in which the static reduction engagement cover is mounted on a static reduction roller is dependent upon such factors as the configuration of the apparatus and rollers, for example, in some instances a roller must be removed from its operational location in order to have an static reduction engagement cover mounted thereon whereas in other instances the cover can be installed with the roll in operating position.

FIG. 1 shows a perspective schematic view of a static reduction roller 100, according to one aspect of the disclosure. Static reduction roller 100 includes a roller 105 having an axle 103 and a central axis of rotation 115. A static reduction engagement cover 160 is affixed over roller 105. Static reduction engagement cover 160 includes electrically conductive regions 165 and non-conductive regions 167 that are separated from each other. Each of the conductive regions 165 and non-conductive regions 167 have a resilient outer surface 169 that can be a knitted looped pile having non-conductive fibers 168, as described elsewhere. The conductive regions 165 further include electrically conductive fibers 166.

During operation, the static reduction engagement cover 160 should not slide or stretch on the underlying roller 105 as this can lead to wear of various components of the apparatus, damage to the web, or other impairment of performance. In many instances, when the static reduction engagement cover 160 is simply a knit fabric as described herein and has a snug fit to the surface of the underlying roller 105, the second face of the static reduction engagement cover 160 will remain firmly positioned on the roller 105 during operation. In some instances, mounting means such as an intermediate adhesive, mated hook and loop fasteners, rigid shell which attaches to the roller, etc. will be used. In some instances, multiple engagement covers of the invention are installed on a single roller, mounted concentrically on the roller with the engagement surface of each orientated outward or away from the roller.

In preferred embodiments, the static reduction engagement cover 160 is knit fabric as described in, for example, co-pending PCT Publication Nos. WO2011/038279 and WO2011/038284, and which can be mounted on the roller as a removable sleeve. The sleeve is preferably seamless and should be of appropriate size to fit around roller snugly without developing any loose bulges or ridges. In many embodiments, the sleeve will be configured to extend beyond both ends of the roller 105 sufficiently far that it can be cinched and tied; if the sleeve is of appropriate dimension this action typically tends to pull the sleeve tight. Typically the sleeve should be at least as wide as the web, preferably wider than the web to ease concerns about alignment of the traveling web.

Mounting the static reduction engagement cover 160 on the roller 105 may be achieved by conventional means dependent in part upon the nature of the static reduction engagement cover and that of the conveying apparatus. Preferably the static reduction engagement cover 160 does not slide on the roller 105 core during operation. In many embodiments, the cover is in the form of a sleeve that fits snugly on the roller, optionally extending beyond the ends of the roller 105 sufficiently to be cinched there. In some embodiments, the static reduction engagement cover 160 and surface of the roller exhibit sufficient frictional effect, in some instances additional means such as adhesive or hook and loop type fastener mechanisms may be used.

While it is typically desirable for the base of a sleeve of the static reduction engagement cover 160 to stretch so as to achieve a snug fit on the static reduction roll 100, the base should not stretch during operation so as to cause bunching underneath the web being conveyed. Alternatively, rollers may be manufactured with engagement covers as described herein being more strongly attached to the outer surface thereof. Further, an advantage of removable embodiments is that it will typically be easier and cheaper to replace removable engagement covers on a roller to replace the engagement surface of rather than refinishing a roller having an integrated engagement surface in accordance with the disclosure.

In a typical embodiment, the cover is made with a knit fabric having a pile-forming loop at every stitch. In an illustrative embodiment there are 25 stitches per inch (1 stitch per millimeter). The fibrous material(s) used to make the fabric may be single filament strands, multifilament strands (for example, two or more strands wound together to yield a single thread), or combinations thereof.

In many embodiments, the looped pile has a loop height (that is, dimension from the plane defined by the top of the base layer to the apex of the pile loops) of from about 0.4 to about 0.8 mm, preferably from about 0.5 to about 0.7 mm. It will be understood that engagement covers having looped pile having loop heights outside this range may be used in certain embodiments. If the loop height is insufficient, the cover may fail to provide effective cushioning effect to the web to achieve the full benefits of the disclosure. If the loop height is too high, the pile may tend to get floppy and undesirably affect web transport or damage the conveyed web.

The pile should be sufficiently dense to be supportive of the web during conveying so as to reliably achieve the benefits of the disclosure. For instance, the looped pile comprises fibers selected to have an appropriate denier for the application, with thicker fibers providing relatively greater resistance to compression. Illustrative examples include fibers having a denier from about 100 to about 500. As will be understood, fibers having a denier outside this range may be used in some embodiments in accordance with the disclosure.

In illustrative embodiments, the non-electrically conductive fibers 168 can be selected from the group consisting of poly(tetrafluoroethylene) (PTFE such as, for example, TEFLON® fiber), aramid (for example, KEVLAR®), polyester, polypropylene, nylon, wool, bamboo, cotton, or a combination thereof. However, those skilled in the art will be able to readily select other fibers which can be effectively knit and used in covers of the disclosure. In some cases, the non-electrically conductive fibers 168 can comprises a material that shrinks when exposed to heat, moisture, or a combination thereof, such as wool, cotton, polyvinylalcohol (PVA), polyester, or a combination thereof.

The electrically conductive fibers 166 can be selected from metal coated fibers such as aluminum, silver, copper or alloys thereof, coated non-electrically conductive fibers 168; metal fibers such as aluminum, silver, copper, or alloys thereof; carbon fibers, or a combination thereof. In one particular embodiment, a conductive polyester fiber such as RESISTAT® P6203 Polyester Filament (available from Jarden Applied Materials, Columbia S.C.) can be used. In some cases, the electrically conductive fibers 166 have a length that includes kinks, bumps, ends or a combination thereof, that form pointed conductive regions. The electrically conductive fibers 166 can comprise a fiber having a size (diameter) ranging from about 3 microns to about 20 microns, although other size fibers can also be used. The electrically conductive fibers 166 can have any length, including continuous fibers extending throughout the entire electrically conductive region 165. In some cases, the electrically conductive fibers 168 comprise a plurality of ends, and are intertwined in electrical contact throughout the resilient engagement surface.

The base is typically knit so as to provide the desired properties to permit it to be placed on a roller and used in accordance with the disclosure, for example, stretch and slide sufficiently easily over the roll to permit it to be installed while not stretching undesirably during operation.

Some illustrative examples of materials that can be used as sleeves to make engagement covers of the disclosure include: HS4-16 and HS6-23 polyester sleeves from Syfilco Ltd., Exeter, Ontario, Canada; WM-0401C, WM-0601, and WM-0801 polyester sleeves from Zodiac Fabrics Company, London, Ontario, Canada or its affiliate Carriff Corp., Midland, N.C.; and BBW3310TP-9.5 and BBW310TP-7.5 sleeves from Drum Filter Media, Inc., High Point, N.C.

Typically, knit fabrics are made using fibrous materials that have been treated with lubricants to facilitate the knitting process. When the resultant knit fabrics are used in web conveyance operations in accordance with the disclosure, such lubricants may tend to wear away causing variation in frictional performance to the web and potential contamination issues. Accordingly, it is typically preferred to wash or scour fabrics used as roller covering herein.

The material(s) selected should be compatible with the web materials and operating conditions, for example, stable and durable under the ambient operating conditions, for example, temperature, humidity, materials present, etc. It has been observed that, if the static reduction engagement cover material(s) are of contrasting color to the web materials, observation of debris capture by the static reduction engagement cover is facilitated, for example, using black polyester fibers in a static reduction engagement cover to be used with a transparent film web.

Typically, because of the requirements of the knitting processes used to make them, knit fabrics are made with fibrous materials that have limited elastomeric character so that the fibers can be moved around in contact with one another to form the desired knit. In many instances, lubricants are applied to the fibers to facilitate the knitting process. It is preferred to remove such lubricants from knits used in the present disclosure, for example, by cleaning or scouring the material such as by washing it before using it. In some instances, the knit can be put into service as an engagement surface of the disclosure with a lubricant being worn away.

Typically it is preferred that the loop pile of the static reduction engagement cover provide a coefficient of friction to the web of from about 0.25 to about 2, with about 1.0 or more often being preferred, though engagement covers providing coefficients of friction outside this range may be used if desired.

The degree of grip or coefficient of friction ("COF") which is desired of the engagement surface to the web is dependent in part upon the function of the subject roller. For instance, in the case of an idler roller or other roller operating under little tension differential, a lower COF is typically satisfactory. In the case of driven rollers, especially highly driven rollers operating under a large tension differential a higher COF is typically desired.

In some cases, in order to simultaneously achieve desired frictional properties with the web, abrasion resistance, radial modulus of elasticity, and resilience of the loop pile, quantities of selected polymeric relatively elastomeric (as compared to the fibrous pile material(s)) materials can be applied to the engagement surface to form grip enhancement elements that raise the effective COF between the engagement surface and web, if desired.

The described invention may be used with known web transport static reduction rollers, including for example, rubber rollers, metal rollers (for example, aluminum, steel, tungsten, etc.), and composite rollers. Rollers may be solid or hollow and may include such apparatus to apply vacuum effects, heating the web, cooling the web, etc. In one particular embodiment, the surface of the roller is a non-conductive material that is in contact with the static reduction engagement cover. In some cases, a conductive material can be included on the surface of the roller to provide a grounding contact; however, the conductive material does not provide a conductive path over the entire surface of the roller, but instead is piecewise conductive, as described elsewhere.

As noted above, in some instances, an apparatus may comprise rollers with multiple static reduction engagement covers installed thereon, mounted concentrically on a roller. This may be done to yield a thicker cushion depth, thus increasing the dampening effect of the static reduction engagement cover(s). Also, in some instance, particularly in large industrial settings, significantly more effort is required to install an static reduction engagement cover on a roller than is necessary to remove it from the roller. Thus, if multiple static reduction engagement covers are installed on a roller, once the outer one is contaminated and/or worn from use, the outer static reduction engagement cover can be removed to expose an underlying static reduction engagement cover for significantly less cost and effort than freshly installing a new cover.

The static reduction rolls can be used in connection with a wide variety of web materials. It is well suited and can provide particular advantage in connection with the manufacture and handling of webs of high quality polymeric materials such as optical films. Such films, typically comprising one or more layers of select polymeric materials, for example, radiation-cured compositions, typically require precise and uniform specifications of width, thickness, film properties, etc. with very low defect rates. The web material may be of monolayer or multilayer construction.

In some embodiments, the web is a simple film, for example, of polyester (for example, photograde polyethylene terephthalate and MELINEX™ PET from DuPont Films) or polycarbonate. In some embodiments, the film comprises such materials as, for example, styrene-acrylonitrile, cellulose acetate butyrate, cellulose acetate propionate, cellulose triacetate, polyether sulfone, polymethyl methacrylate, polyurethane, polyester, polycarbonate, polyvinyl chloride, polystyrene, polyethylene naphthalate, copolymers or blends based on naphthalene dicarboxylic acids, polycyclo-olefins, and polyimides.

The static reduction engagement covers described herein have a low radial modulus of elasticity with enhanced tribological characteristics. As a result, the disclosure provides a convenient, low cost way to reduce undesirable effects on the web during web transport and handling.

The static reduction engagement covers provide a resilient low radial modulus of elasticity character to the roller surface which compensates for many pertubations encountered in a complex web transport system, for example, tension variations and speed variations, due to any of a myriad of causes, for example, variation in web properties such as thickness, modulus, etc., variations in performance or characteristics of individual rolls in a system comprising many rolls, power fluctuations in drive rolls, and the like. In accordance with the disclosure, the covers enable the web to avoid buckling and wrinkling when it otherwise might. In addition, the cover has been found to dampen velocity and tension variability of the web as it travels through the web line. As a result, high quality webs, for example, optical grade webs, can be processed at high speeds, for example, 100 fpm, 150 fpm, 170 fpm, or more, with reduced web degradation, for example, buckling, scuffing, etc. Furthermore, the pile construction is believed to entrap contamination, for example, dirt particles, that would otherwise damage the web being processed.

The static reduction rolls described herein may be used on web transport apparatus having just one or two rolls, or systems having many more rolls. The static reduction engagement covers may be used on one or two selected static reduction rolls in a system or in many, or even all, rolls throughout the system as desired.

Figure 2:
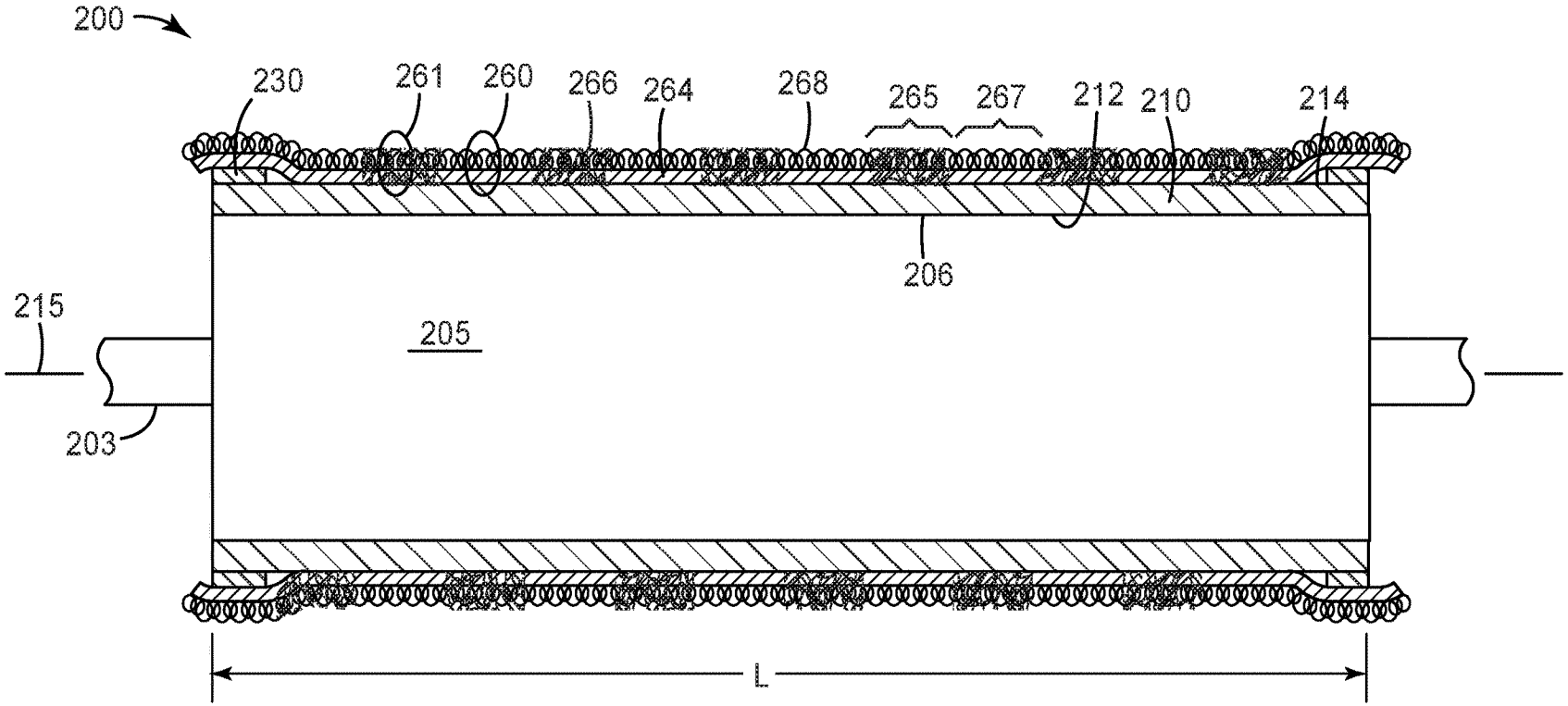
FIG. 2 shows a side cross-sectional view of a static reduction roller.

FIG. 2 shows a side cross-sectional view of a static reduction roller 200, according to one aspect of the disclosure. Static reduction roller 200 includes an insulative tube 210 having an inner surface 212, an outer surface 214 and a length "L". The insulative tube 210 can be releasably attached to a mandrel 205 having an axle 203 which rotates within bearings (not shown) around a central axis of rotation 215. In some cases, the static reduction roller 200 can instead be fabricated from an insulating material, in which case the insulative tube 210 could extend throughout the mandrel 205; however, typically the mandrel comprises a conductive metal such as steel, and the insulative material forms an outer shell or insulative tube 210.

In one particular embodiment, the insulative tube 210 can be releasably attached to the mandrel 205 using, for example, a plurality of expandable members (not shown) that extend beyond an outer mandrel surface 206 when the insulative tube 210 is attached, and retract into the outer mandrel surface 206 to release the insulative tube 210. A static reduction engagement cover 260 comprises a non-conductive region 267 including a resilient looped pile fabric 268 and a base layer 264; and an adjacent electrically conductive region 265 including the resilient looped pile fabric 268, the base layer 264, and electrically conductive fibers 266 that extend throughout a static reduction engagement cover conductive portion 261. In some cases, the electrically conductive region 265 can form a spiral conductive path around the static reduction engagement cover 260 such that each successive wrap of the electrically conductive region 265 is separated by non-conductive region 267 as shown in FIGS. 1 and 2. In some cases, the electrically conductive region 265 can form other patterns which are also separated by non-conductive regions 267, as described elsewhere.

The static reduction engagement cover 260 is disposed over the outer surface 214 of the insulative tube 210, such that the base layer 264 is adjacent the outer surface 214. In some cases, additional layers (not shown) such as additional knit or woven base layers that include conductive fibers to distribute and collect charges; compliant layers including rubber, closed- or open-celled foam; and the like, can be disposed between the base layer 264 and the outer surface 214 of the insulative tube 210.

The static reduction engagement cover 260 can be attached to the outer surface 214 of the insulative tube 210 using any suitable technique including, for example, compression, adhesion, mechanical attachment, or a combination thereof. Generally, it can be preferable to releasably attach the static reduction engagement cover 260 to the outer surface 214 of the insulative tube 210 so that different covers can be used on the same tube; however, in some cases the attachment can be more permanently made. In some cases, the static reduction engagement cover 260 can be attached using compression by including a fiber in the static reduction engagement cover 260 that shrinks upon exposure to heat and/or moisture such as, for example, wool fibers, cotton fibers, polyvinylalcohol (PVA) fibers, and the like. In one particular embodiment, PVA fibers can be spun into a yarn and then woven such as those under the trade designation Solvron® available from Nitivy Co. Ltd., Tokyo, Japan, can be especially preferred for a material that shrinks upon exposure to heat and moisture.

In some cases, the static reduction engagement cover 260 can be non-releasable attached to the outer surface 214 of the insulative tube 210 using adhesives including, for example, two-sided transfer tapes, solvent coated PSAs, hot-melt adhesives, and the like. In some cases, the static reduction engagement cover 260 can be affixed to the outer surface 214 using a plurality of optional mechanical attachment elements 230. In one particular embodiment, the mechanical attachment elements 230 can be a hook portion of a hook-and-loop mechanical fastener such as, for example, Scotchmate™ Hook & Loop Tape available from 3M Company, that is adhesively attached near the ends of the outer surface 214.

Figure 3A:
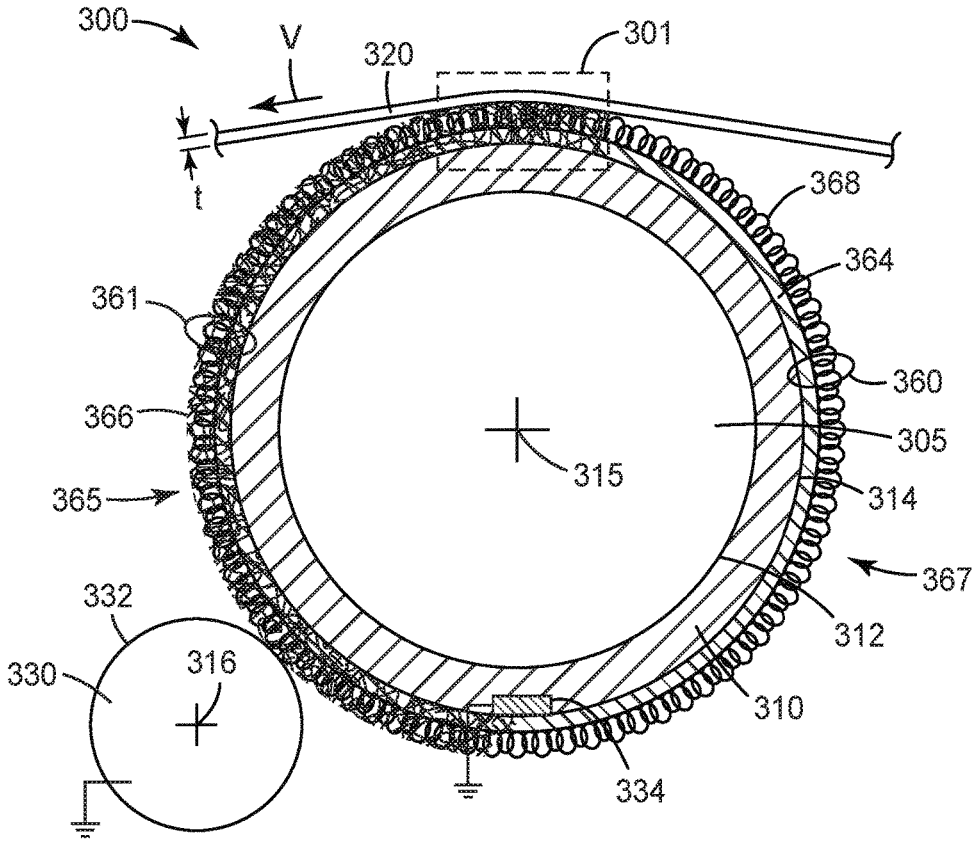
FIG. 3A shows a cross-sectional end view of a static reduction roller.

FIG. 3A shows a cross-sectional end view of a static reduction roller 300, according to one aspect of the disclosure. Each of the elements 305-368 shown in FIG. 3A correspond to like-numbered elements shown in FIG. 2, which have been described previously. For example, insulative tube 310 in FIG. 3A corresponds to insulative tube 210 in FIG. 2, and so on. Static reduction roller 300 includes an insulative tube 310 having an inner surface 312 adjacent the roller 105, an outer surface 314, and a central axis of rotation 315. A static reduction engagement cover 360 comprises a non-conductive region 367 including a resilient looped pile fabric 368 and a base layer 364; and an adjacent electrically conductive region 365 including the resilient looped pile fabric 368, the base layer 364, and electrically conductive fibers 366 that extend throughout a static reduction engagement cover conductive portion 361. The electrically conductive region 365 can form a spiral conductive path around the static reduction engagement cover 360 such that each successive wrap of the electrically conductive region 365 is separated by non-conductive region 367 as shown in FIGS. 1 and 2, and therefore the cross-sectional slice shown in FIG. 3A shows the separation of the electrically conductive region 365 and non-conductive region 367 around a circumference of the static reduction engagement cover 360.

In one particular embodiment, a web (for example, a film) 320 having a distributed static electric charge can be brought into contact with the static reduction roller 300 in contact region 301, to effect a discharge and neutralization of the static charge. The polymeric film 320, which has a thickness "t" and is travelling at a web speed "V", can contact the static reduction engagement cover 360 around static reduction roller 300.

An electrically conductive path can be made from the electrically conductive region 365 to the local ground by several techniques. In one particular embodiment, one or more optional conductive rollers 330, each having a conductive surface 332 and a discharge axis of rotation 316 parallel to the central axis of rotation 315, can be positioned such that the electrically conductive surface 332 makes electrical contact to ground with the electrically conductive region 365 of the static reduction engagement cover 360, to bleed off the static charge. In another embodiment, a plurality of optional conductive traces 334 can instead be embedded within the insulative tube 310 such that electrical contact with the local ground is made at positions removed from the contact region 301 of the web 320 with the static reduction roller 300. In another embodiment, the plurality of optional conductive traces 334 can instead include a separate layer, such as additional knit or woven base layer that includes conductive fibers to distribute and/or collect charges disposed over the surface of the insulative tube 310, as described elsewhere. In some cases, the plurality of optional conductive traces 334 can be aligned parallel to the central axis 315, or they can be aligned as a spiral around the outer surface 314, or in a conductive net distribution over of the insulative tube.

Figure 3B:
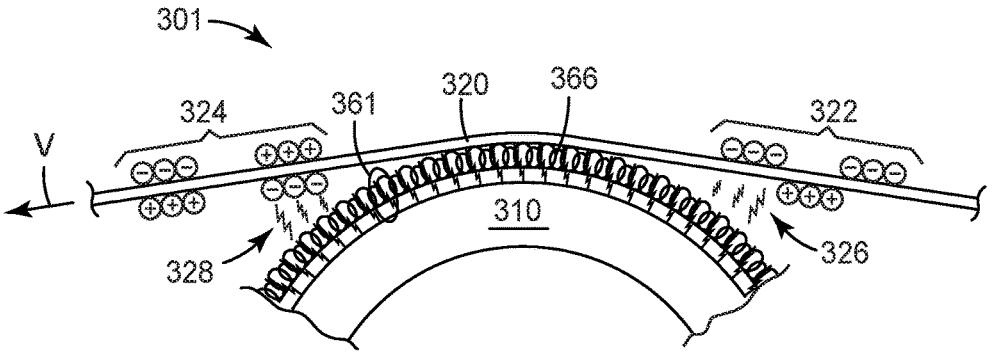
FIG. 3B shows an enlarged view of the static reduction roller of FIG. 3A.

FIG. 3B shows an enlarged view of the static reduction roller 300 of FIG. 3A in the contact region 301, according to one aspect of the disclosure. Each of the elements 305-368 shown in FIG. 3B correspond to like-numbered elements shown in FIG. 3A, which have been described previously. For example, insulative tube 310 in FIG. 3B corresponds to insulative tube 310 in FIG. 3A, and so on. A web 320 having a distributed static electric charge 322 can be brought into contact with the static reduction engagement cover conductive portion 361 in contact region 301, to discharge and neutralize of the static charge. In one particular embodiment, the distributed static electric charge 322 can be resident on both sides of the web 320, in part depending on the thickness and material of the web 320. A corona threshold voltage can be reached, and first corona effect neutralizing ions 326 and second corona effect neutralizing ions 328 can neutralize the web such that a neutral static charge 324 condition is on the web 220 after leaving the contact region 301.

Figure 3C:
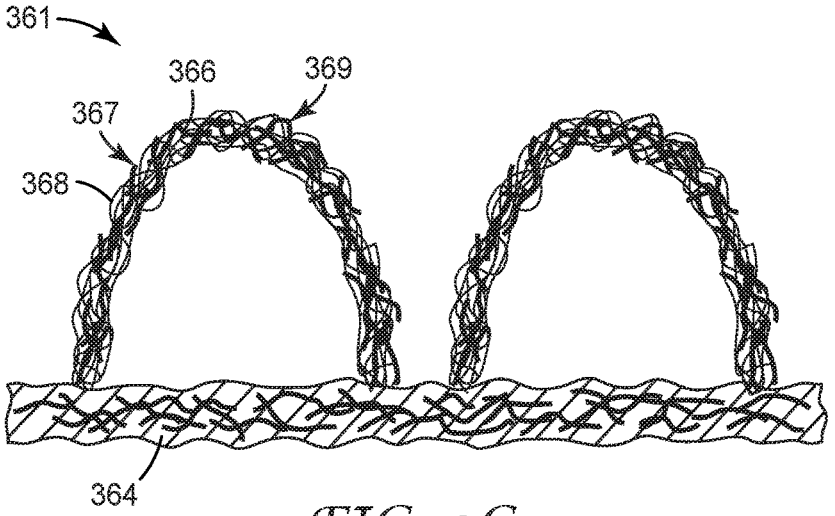
FIG. 3C shows an enlarged view of the static reduction engagement cover conductive portion of FIGS. 3A and 3B.

FIG. 3C shows an enlarged view of a static reduction engagement cover conductive portion 361 of FIGS. 3A and 3B, according to one aspect of the disclosure. The static reduction engagement cover conductive portion 361 includes the base layer 364 and resilient looped pile fabric 368, into which the electrically conductive fibers 366 extend. In one particular embodiment, the electrically conductive fibers 366 can include a plurality of ends 367 and kinks 369 that collectively form points from which corona discharge has been shown to be more readily generated, as described elsewhere. The plurality of ends 367 can be formed using several techniques including, for example, by using short electrically conductive fibers 366, or by fracturing or cutting longer electrically conductive fibers 366 in the region of the resilient looped pile fabric 368. In a similar manner, the plurality of kinks 369 (or alternately bumps) can be formed using several techniques including, for example, compressing, crumpling, or folding during manufacture of the electrically conductive fibers 366.

Figure 4:
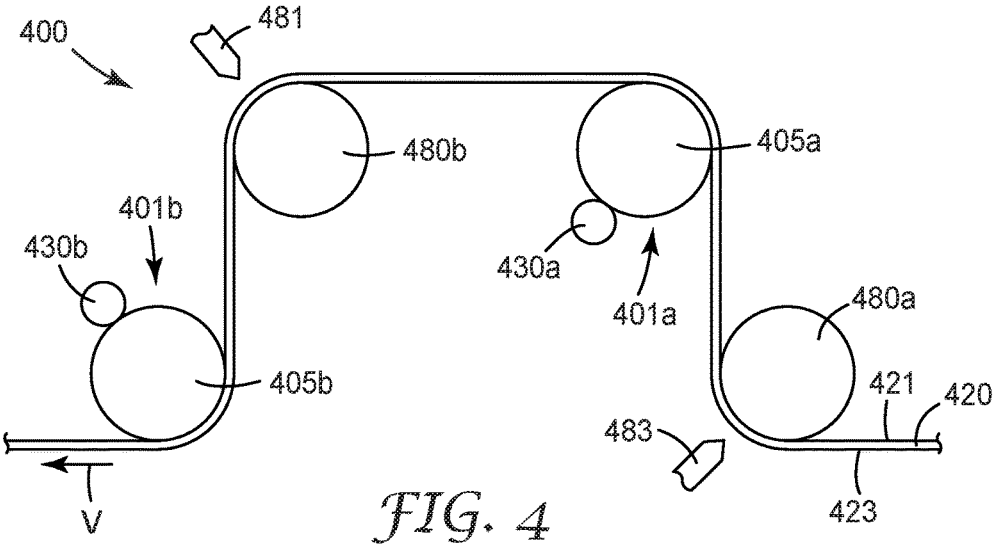
FIG. 4 shows a schematic view of a static reduction apparatus.

FIG. 4 shows a schematic view of a static reduction apparatus 400, according to one aspect of the disclosure. Static reduction apparatus 400 includes a first backing roller 480, a first static reduction roller 401*a* including a first roller 405*a* and a first conductive roller 430*a*, a second backing roller 480*b*, and a second static reduction roller 401*b* including a second roller 405*b* and a second conductive roller 430*b*. A web 420 having a first major surface 21 and an opposing second major surface 423 travels at a velocity "V" through the static reduction apparatus 400 from right to left as shown in FIG. 4. The path of the web 420 will be described as the web 420 travels from right to left.

An optional first corona discharge 483 is positioned to discharge proximate the opposing second major surface 423 as the first major surface 421 of web 420 passes over the first backing roller 480*a*. The opposing second major surface 423 of web 420 having been charged by the corona to remove any resident static patterns then passes in contact with first static reduction roller 401*a*, and first conductive roller 430*a* bleeds the accumulated charge to ground, as described elsewhere. The first major surface 421 of the web 420 is then charged by an optional second corona discharge 481 as the opposing second major surface 423 passes over the second backing roller 480*b*. The first major surface 421 of web 420 having been charged by the corona to remove any resident static patterns then passes in contact with second static reduction roller 401*b*, and second conductive roller 430*b* bleeds the accumulated charge to ground, as described elsewhere.

Figure 5A:
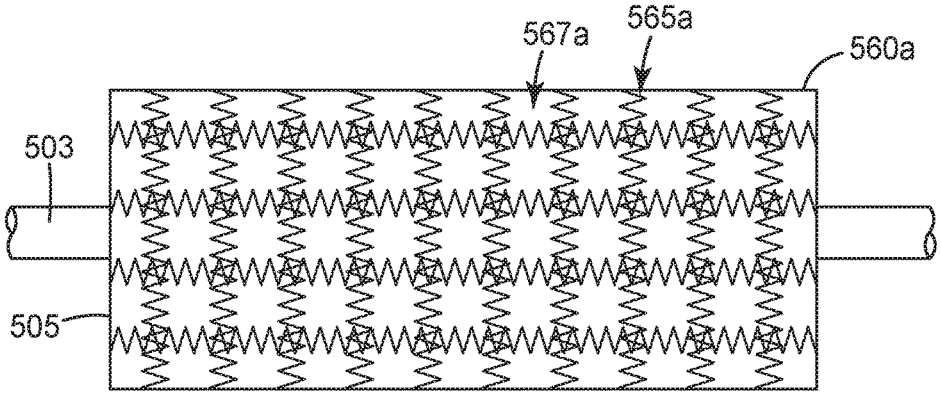
FIG. 5A-5C shows embodiments of static reduction roller conductive patterns.
Figure 5B:
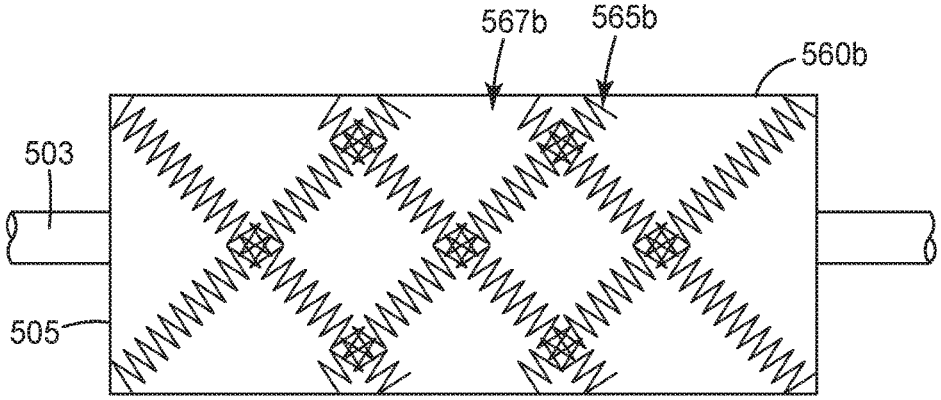
Figure 5C:
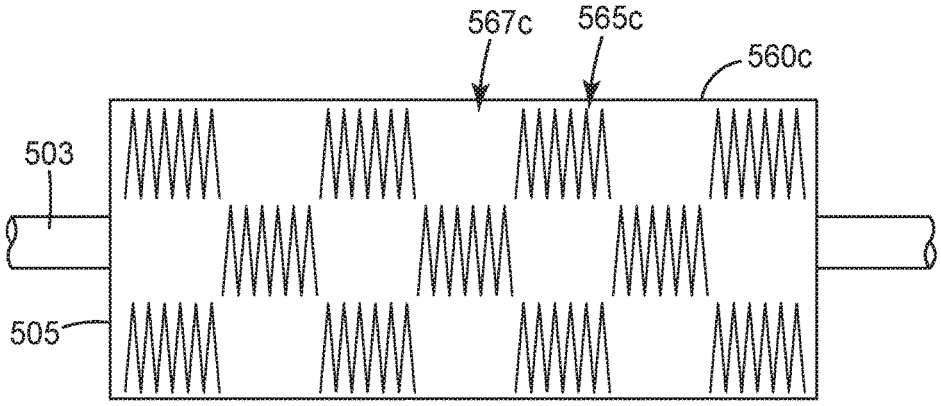

FIG. 5A-5C shows embodiments of static reduction roller conductive patterns, according to one aspect of the disclosure. In FIG. 5A, a roller 505 having an axle 503 is covered with a static reduction engagement cover 560*a* that includes electrically conductive regions 565*a* and non-conductive regions 567*a* arranged in a grid pattern. In FIG. 5B, a roller 505 having an axle 503 is covered with a static reduction engagement cover 560*b* that includes electrically conductive regions 565*b* and non-conductive regions 567*b* arranged in a diamond pattern. In FIG. 5C, a roller 505 having an axle 503 is covered with a static reduction engagement cover 560*c* that includes electrically conductive regions 565*c* and non-conductive regions 567*c* arranged in a checkerboard pattern.

EXAMPLES

Example 1

A static reduction roller cover was made of polyester with a conductive row of fibers every twelfth row. Each conductive row consisted of a ground stitch made of a silver coated polyester yarn, X-static®, available from Noble Biomaterials, Scranton, Pa. With each conductive row there was a terry loop which was made up of a spun yarn having 50% polyester fibers and 50% X-static®. This static reduction roller cover was pulled tightly over a 6 inch (15.24 cm) diameter aluminum roller. The aluminum roller was connected to earth ground via conducting mounting brackets. Measurement of the resistance to ground of the surface of the aluminum roller to the winder frame showed resistance of less than 1 ohm. The electrical resistance from the conductive stitch of the static reduction roller cover to the ground of the winder frame was measured to be approximately 100 kOhms.

A polyethylene terephthalate (PET) web having a thickness of 2.0 mil (0.051 mm) was unwound and passed beneath a DC corona wire electrode operating at 8 kV. The corona wire was positioned over a ground rubber coated idler roll, and the unwind speed was 200 ft/min (61.0 m/min). The electric field was measured with a Monroe Electrostatic Monitor, model #177A, available from Monroe Electronics, Lyndonville N.Y. The electrostatic field was measured after charging but before neutralization with a calibrated Monroe model 1036E field meter, positioned approximately 1 cm from the surface of the PET web (position 1), and physically distanced from any field attenuating rollers. Following neutralization, a second 1036E field meter was positioned (position 2) in a similar manner to the field meter of position 1. The resulting electrostatic field measurements were 8.0 kV/cm at position 1, and 2.0 kV/cm at position 2.

Example 2

A grounding matrix on an aluminum roller was made using X-static® yarn, which was wound around a 4.5 inch (11.43 cm) aluminum roll in a crisscross pattern with a spacing of about 0.5 inch (1.27 cm). The roll was first covered with a polyester film to assist getting the static reduction roller cover on, due to the presence of adhesive on the roll which didn't allow the static reduction roller cover to slip over it. The yarn was brought to a bare spot in the aluminum roll to help with the grounding.

The static reduction roller cover was made of polyester with a conductive row of fibers every sixth row. Each conductive row consisted of a ground stitch made of X-static® polyester yarn. With each conductive row there was a terry loop made of a spun yarn having 50% polyester and 50% carbon coated polyester (Resistat®, available from Resistat Fiber Collection, Enka, N.C.). The spun yarn having polyester/Resistat® fibers was knitted such that there was electrical contact with the silver-coated X-Static® Yarn in the ground stitch. The static reduction roller cover was pulled tightly over the roller, immediately following an unwind station, and a second static reduction roller cover of identical configuration as the first static reduction roller cover, was pulled tightly over a second 4.5 inch (11.43 cm) aluminum roller.

The electrical resistance from the conductive stitch of the static reduction roller cover to the ground of the winder frame was measured to be approximately 100 Ohms. The voltage of the web was then measured using an Ion Systems Model 775, Electrostatic Fieldmeter, available from Simco-Ion, Hatfield, Pa. This electrostatic probe was positioned approximately 1 inch (2.54 cm) from the web in a free span, a position separated from any rollers, in order to minimize attenuation of the voltage due to field suppression. The voltage was measured immediately after the unwind station (position 1), following a first roller covered with the static reduction roller cover as described above (position 2), and finally following the second roller covered with the identical static reduction roller cover (position 3). The resulting measured voltage levels were 14-16 kV at position 1, 2.0-4.0 kV at position 2, and 0.0-2.0 kV at position 3.

Example 3

A grounding matrix on a fiberglass roller was made using X-static® yarn, which was knit into a netting and then pulled on a 6 inch (15.24 cm) fiberglass roll to produce a grid pattern of 1 inch (2.54 cm) squares. Each grid line of the netting was made up of a plurality of fibers, and the grounding grid was brought to the ends of the roll, which was bare aluminum having a conductive copper foil tape wrap.

The static reduction roller cover was made of polyester with a conductive row of fibers every twelfth row. Each conductive row consisted of a ground stitch of X-static®. With each conductive row there was a terry loop having a spun yarn with 50% polyester and 50% X-static®. The spun yarn polyester/X-Static® was knitted in such a way there was contact with the X-Static® yarn in the ground stitch. This static reduction roller cover was pulled tightly over a 6 inch (15.24 cm) diameter non-electrically conductive fiberglass roller previously wrapped with the grounding matrix described above. The conductive path to ground was solely due to the grounding matrix. The electrical resistance from the conductive stitch of the static reduction roller cover to the ground of the winder frame was measured to be approximately 100 Ohms.

A PET web having a thickness of 2 mil (0.051 mm) was unwound and passed beneath a DC corona wire electrode operating at 8 kV, at an unwind speed of 200 ft/min (61.0 m/min). The corona wire was positioned over a rubber coated idler roll. Following the charging of the film, the electric filed was measured with a Monroe Electrostatic Monitor, model #177A. The electrostatic field was measured after charging but before neutralization, with a calibrated Monroe model 1036E field meter. The meter was positioned approximately 1 cm from the surface of the PET web (position 1), separated from any field attenuating rollers. Following neutralization, a second Monroe model 1036E field meter was also positioned approximately 1 cm from the surface of the PET web (position 2), separated from any field attenuating rollers. The resulting electrostatic field measurements were 8.0 kV/cm at position 1, and 0.0-0.1 kV/cm at position 2.

Following are a list of embodiments of the present disclosure.

Item 1 is a static reduction roller, comprising: a roller having a low-conductivity major surface, a central axis, and two ends; a static reduction engagement cover having an inner surface and an outer surface, the inner surface adjacent the major surface of the roller, the static reduction engagement cover comprising: a resilient engagement surface; and electrically conductive fibers, wherein the electrically conductive fibers are disposed throughout the resilient engagement surface such that a portion of the electrically conductive fibers are proximate the outer surface.

Item 2 is the static reduction roller of item 1, wherein the electrically conductive fibers are disposed in a first region of the resilient engagement surface and absent in a second adjacent region of the resilient engagement surface.

Item 3 is the static reduction roller of item 2, wherein the first region and the second adjacent region form a spiral pattern across the major surface of the roller.

Item 4 is the static reduction roller of item 2 or item 3, wherein the first region and the second adjacent region form a grid pattern across the major surface of the roller.

Item 5 is the static reduction roller of item 1 to item 4, wherein the electrically conductive fibers comprise metal coated fibers, metal fibers, alloy fibers, carbon fibers, or a combination thereof.

Item 6 is the static reduction roller of item 1 to item 5, wherein the electrically conductive fibers have a length that includes kinks, bumps, ends or a combination thereof, that form pointed conductive regions.

Item 7 is the static reduction roller of item 1 to item 6, wherein the resilient engagement surface is a knit fabric comprising a base layer having first and second faces and a resilient looped pile protruding from the first face.

Item 8 is the static reduction roller of item 7, wherein the base layer comprises a woven base layer, a knitted base layer, a non-woven base layer, or a combination thereof.

Item 9 is the static reduction roller of item 7, wherein the electrically conductive fibers are disposed in the resilient looped pile.

Item 10 is the static reduction roller of item 1 to item 9, wherein the static reduction engagement cover attaches to the major surface of the reverse crown roll by compression, adhesion, mechanical attachment, or a combination thereof.

Item 11 is the static reduction roller of item 1 to item 10, wherein the static reduction engagement cover comprises a tube shape or a rectangle shape.

Item 12 is the static reduction roller of item 7, wherein the resilient looped pile comprises a fibrous material selected from poly(tetrafluoroethylene), aramid, polyester, polypropylene, polyethylene, nylon, wool, bamboo, cotton, or a combination thereof.

Item 13 is the static reduction roller of item 1 to item 12, further comprising a plurality of electrically conductive regions disposed on the low-conductivity major surface, each electrically conductive region parallel to the central axis and electrically isolated from adjacent electrically conductive regions.

Item 14 is the static reduction roller of item 1 to item 13, wherein the static reduction engagement cover further comprises a material that shrinks when exposed to heat, moisture, or a combination thereof.

Item 15 is the static reduction roller of item 14, wherein the material that shrinks comprises wool, cotton, polyvinylalcohol (PVA), polyester, or a combination thereof.

Item 16 is the static reduction roller of item 1 to item 15, further comprising an adhesive disposed between at least a portion of the low conductivity major surface and the engagement cover.

Item 17 is the static reduction roller of item 1 to item 16, further comprising a hooked fastener disposed adjacent to at least one end of the outer surface of the roller, thereby attaching the static reduction engagement cover to the roller.

Item 18 is the static reduction roller of item 1 to item 17, wherein the resilient looped pile fabric comprises a fiber having a size ranging from about 35 denier to about 400 denier.

Item 19 is the static reduction roller of item 1 to item 18, wherein the resilient looped pile fabric comprises loops having a height from about 0.25 mm to about 5 mm.

Item 20 is the static reduction roller of item 1 to item 19, wherein the electrically conductive fibers comprise a fiber having a size ranging from about 3 microns to about 20 microns.

Item 21 is the static reduction roller of item 1 to item 20, wherein the electrically conductive fibers comprise a plurality of ends, and are intertwined in electrical contact throughout the resilient engagement surface.

Item 22 is the static reduction roller of item 1 to item 21, further comprising a grounding matrix disposed between the low-conductivity major surface and the inner surface of the static reduction engagement cover.

Item 23 is the static reduction roller of item 22, wherein the grounding matrix comprises electrically conductive fibers that are knitted into a net.

Item 24 is an apparatus for reducing static on a web, comprising: a static reduction roller according to item 1 to item 23, capable of rotating around the central axis; and an electrically conductive roll in engaging contact with the outer surface of the static reduction engagement cover and in electrical contact with an electrical ground, wherein a first major surface of a web material contacts the static reduction roll essentially parallel to the central axis in a first region, and the electrically conductive roll contacts the static reduction roll in a second region separated from the first region while conveying the web material in a downweb direction perpendicular to the central axis.

Item 25 is the apparatus of item 24, further comprising: a second static reduction roller according to item 1 to item 23, capable of rotating around the central axis; and a second electrically conductive roll in engaging contact with the outer surface of the static reduction engagement cover and in electrical contact with an electrical ground, wherein a second major surface of the web material contacts the second static reduction roll essentially parallel to the central axis in a third region, and the second electrically conductive roll contacts the second static reduction roll in a fourth region separated from the third region while conveying the web material in the downweb direction perpendicular to the central axis.

Item 26 is the apparatus of item 24 or item 25, further comprising a corona discharge generator positioned adjacent the first major surface of the web material, upweb from the static reduction roll.

Item 27 is the apparatus of item 25, further comprising a second corona discharge generator positioned adjacent the second major surface of the web material, upweb from the static reduction roll.

Item 28 is a method for reducing static on a web, comprising: providing an apparatus according to item 24 to item 27; conveying the web material in a downweb direction perpendicular to the central axis; and contacting the moving web material with the resilient engagement surface of the static reduction roll, thereby removing static charge from the web material and discharging the static charge to the electrical ground.

Item 29 is the method of item 28, further comprising: charging the web material with a corona discharge prior to contacting the moving web material with the resilient engagement surface.

Unless otherwise indicated, all numbers expressing feature sizes, amounts, and physical properties used in the specification and claims are to be understood as being modified by the term "about". Accordingly, unless indicated to the contrary, the numerical parameters set forth in the foregoing specification and attached claims are approximations that can vary depending upon the desired properties sought to be obtained by those skilled in the art utilizing the teachings disclosed herein.

All references and publications cited herein are expressly incorporated herein by reference in their entirety into this disclosure, except to the extent they may directly contradict this disclosure. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A static reduction roller, comprising:

a roller having an electrically insulative major surface, a central axis, and two ends;

a static reduction engagement cover having an inner surface and an outer surface, the inner surface adjacent the major surface of the roller, the static reduction engagement cover comprising:

as its resilient outer surface a knit fabric comprising a base layer having first and second faces and a resilient looped pile protruding from the first face, the resilient looped pile fabric comprising loops having a height from about 0.25 mm to about 5 mm; and electrically conductive fibers selected from the group consisting of metal coated fibers, metal fibers, alloy fibers, carbon fibers, or a combination thereof, wherein the electrically conductive fibers are disposed throughout the resilient engagement cover such that a portion of the electrically conductive fibers are proximate the outer surface of the static reduction engagement cover.

2. The static reduction roller of claim 1, wherein the electrically conductive fibers are disposed in a first region of the resilient engagement surface and absent in a second adjacent region of the resilient engagement surface.

3. The static reduction roller of claim 2, wherein the first region and the second adjacent region form a spiral pattern across the major surface of the roller.

4. The static reduction roller of claim 2, wherein the first region and the second adjacent region form a grid pattern across the major surface of the roller.

5. The static reduction roller of claim 1, wherein the electrically conductive fibers have a length that includes kinks, bumps, ends or a combination thereof, that form pointed conductive regions.

6. The static reduction roller of claim 1, wherein the base layer comprises a woven base layer, a knitted base layer, a non-woven base layer, or a combination thereof.

7. The static reduction roller of claim 1, wherein the electrically conductive fibers are disposed in the resilient looped pile.

8. The static reduction roller of claim 1, wherein the major surface of the roller has a reverse crown and the static reduction engagement cover attaches to the major surface by compression, adhesion, mechanical attachment, or a combination thereof.

9. The static reduction roller of claim 1, wherein the static reduction engagement cover comprises a tube shape or a rectangle shape.

10. The static reduction roller of claim 1, wherein the resilient looped pile comprises a fibrous material selected from poly(tetrafluoroethylene), aramid, polyester, polypropylene, polyethylene, nylon, wool, bamboo, cotton, or a combination thereof.

11. The static reduction roller of claim 1, further comprising a plurality of electrically conductive regions disposed on the major surface, each electrically conductive region parallel to the central axis and electrically isolated from adjacent electrically conductive regions.

12. The static reduction roller of claim 1, wherein the static reduction engagement cover further comprises a material that shrinks when exposed to heat, moisture, or a combination thereof.

13. The static reduction roller of claim 12, wherein the material that shrinks comprises wool, cotton, polyvinylalcohol (PVA), polyester, or a combination thereof.

14. The static reduction roller of claim 1, further comprising an adhesive disposed between at least a portion of the major surface and the engagement cover.

15. The static reduction roller of claim 1, further comprising a hooked fastener disposed adjacent to at least one end of the outer surface of the roller, thereby attaching the static reduction engagement cover to the roller.

16. The static reduction roller of claim 1, wherein the resilient looped pile fabric comprises a fiber having a size ranging from about 35 denier to about 400 denier.

17. The static reduction roller of claim 1, wherein the electrically conductive fibers comprise a fiber having a size ranging from about 3 microns to about 20 microns.

18. The static reduction roller of claim 1, wherein the electrically conductive fibers comprise a plurality of ends, and are intertwined in electrical contact throughout the resilient engagement cover.

19. The static reduction roller of claim 1, further comprising a grounding matrix disposed between the electrically insulative major surface and the inner surface of the static reduction engagement cover.

20. The static reduction roller of claim 19, wherein the grounding matrix comprises electrically conductive fibers that are knitted into a net.

21. An apparatus for reducing static on a web, comprising:

a static reduction roller according to claim 1; and an electrically conductive roll in engaging contact with the outer surface of the static reduction engagement cover and in electrical contact with an electrical ground, wherein a first major surface of a web material contacts the static reduction roll essentially parallel to the central axis in a first region, and the electrically conductive roll contacts the static reduction roll in a second region separated from the first region while conveying the web material in a downweb direction perpendicular to the central axis.

22. The apparatus of claim 21, further comprising:

a second static reduction roller according to claim 21, capable of rotating around its central axis; and a second electrically conductive roll in engaging contact with the outer surface of the static reduction engagement cover and in electrical contact with an electrical ground, wherein a second major surface of the web material contacts the second static reduction roll essentially parallel to the central axis of the second static reduction roller in a third region, and the second electrically conductive roll contacts the second static reduction roll in a fourth region separated from the third region while conveying the web material in the downweb direction perpendicular to the central axis of the second static reduction roller.

23. The apparatus of claim 21, further comprising a corona discharge generator positioned adjacent the first major surface of the web material, upweb from the static reduction roll.

24. The apparatus of claim 23, further comprising a second corona discharge generator positioned adjacent the second major surface of the web material, upweb from the static reduction roll.

25. A method for reducing static on a web comprising polymeric film, comprising:

providing an apparatus according to claim 21;

conveying the web material in a downweb direction perpendicular to the central axis of the static reduction roller; and contacting the moving web material with the outer surface of the resilient engagement cover of the static reduction roller, thereby removing static charge from the web material and discharging the static charge to the electrical ground.

26. The method of claim 25, further comprising:

charging the web material with a corona discharge prior to contacting the moving web material with the outer surface of the resilient engagement cover.

27. The method of claim 25 wherein the resilient looped pile has a coefficient of friction from about 0.25 to about 2.0 with the web material.

* * * * *